US009246236B2

(12) United States Patent
Lecam et al.

(10) Patent No.: US 9,246,236 B2
(45) Date of Patent: Jan. 26, 2016

(54) DUAL-POLARIZATION RADIATING ELEMENT OF A MULTIBAND ANTENNA

(75) Inventors: Patrick Lecam, Lannion (FR); Jean-Pierre Harel, Lannion (FR); Aurélien Hilary, Lannion (FR)

(73) Assignee: Alcatel Lucent, Boulogne-Billancourt (FR)

( * ) Notice: Subject to any disclaimer, the term of this patent is extended or adjusted under 35 U.S.C. 154(b) by 331 days.

(21) Appl. No.: 13/700,306

(22) PCT Filed: May 26, 2011

(86) PCT No.: PCT/EP2011/058684

§ 371 (c)(1),
(2), (4) Date: Mar. 27, 2013

(87) PCT Pub. No.: WO2011/147937

PCT Pub. Date: Dec. 1, 2011

(65) Prior Publication Data

US 2013/0187821 A1 Jul. 25, 2013

(30) Foreign Application Priority Data

May 28, 2010 (FR) ..... 10 54150

(51) Int. Cl.

| | |
|---|---|
| ***H01Q 21/28*** | (2006.01) |
| ***H01Q 1/24*** | (2006.01) |
| ***H01Q 1/38*** | (2006.01) |
| ***H01Q 19/10*** | (2006.01) |

(Continued)

(52) U.S. Cl.

CPC ..... *H01Q 21/28* (2013.01); *H01Q 1/246* (2013.01); *H01Q 1/38* (2013.01); *H01Q 19/108* (2013.01); *H01Q 21/061* (2013.01); *H01Q 21/20* (2013.01); *H01Q 21/24* (2013.01); *H01Q 21/30* (2013.01)

(58) Field of Classification Search

CPC ..... H01Q 1/38; H01Q 19/108
USPC ..... 343/799
See application file for complete search history.

(56) References Cited

U.S. PATENT DOCUMENTS

| | | | |
|---|---|---|---|
| 4,114,164 | A | 9/1978 | Greiser |
| 5,548,299 | A | 8/1996 | Tsuda et al. |

(Continued)

FOREIGN PATENT DOCUMENTS

| | | |
|---|---|---|
| CN | 1345108 | 4/2002 |
| EP | 1 056 154 A1 | 11/2000 |

(Continued)

OTHER PUBLICATIONS

International Search Report for PCT/EP2011/058684 dated Jul. 12, 2011.

*Primary Examiner* — Hoang V Nguyen
*Assistant Examiner* — Michael Bouizza
(74) *Attorney, Agent, or Firm* — Fay Sharpe LLP

(57) ABSTRACT

A dual-polarization radiating element for a multiband antenna comprises a support with a high dielectric constant whose shape is roughly cylindrical, having an axis of revolution, at least a first and a second pair of dipoles printed on a first surface of the support, the dipoles of the first pair being roughly orthogonal to the dipoles of the second pair, and conductive lines, to feed each dipole, printed onto a second surface of the support. The support is placed on a flat reflector, with the cylindrical support's axis of revolution being perpendicular to the plane of the reflector.

13 Claims, 4 Drawing Sheets

(51) Int. Cl.

| | |
|---|---|
| ***H01Q 21/06*** | (2006.01) |
| ***H01Q 21/20*** | (2006.01) |
| ***H01Q 21/24*** | (2006.01) |
| ***H01Q 21/30*** | (2006.01) |

(56) References Cited

U.S. PATENT DOCUMENTS

| | | | | |
|---|---|---|---|---|
| 6,166,702 | A | 12/2000 | Audenaerde et al. | |
| 6,278,413 | B1 | 8/2001 | Hugh et al. | |
| 6,525,697 | B1 * | 2/2003 | Theobold | 343/895 |
| 7,579,992 | B2 | 8/2009 | Ryou et al. | |
| 8,199,063 | B2 | 6/2012 | Moon et al. | |
| 2002/0021257 | A1 | 2/2002 | Zimmerman | |
| 2006/0187124 | A1 | 8/2006 | Goldberg | |
| 2006/0279471 | A1 | 12/2006 | Zimmerman | |
| 2010/0007570 | A1 | 1/2010 | Sardariani et al. | |
| 2011/0175782 | A1 | 7/2011 | Choi et al. | |

FOREIGN PATENT DOCUMENTS

| | | |
|---|---|---|
| JP | 3-242006 | 10/1991 |
| JP | 2581246 | 2/1997 |
| JP | 2001-274620 | 10/2001 |
| JP | 2002-71776 | 3/2002 |
| JP | 2002-111358 | 4/2002 |
| JP | 2003-318635 | 11/2003 |
| JP | 2004-159088 | 6/2004 |
| JP | 2005-203962 | 7/2005 |
| JP | 2008-503972 | 2/2008 |
| JP | 2010-503356 | 1/2010 |
| KR | 2010-0033888 | 3/2010 |
| WO | WO 00/59067 A2 | 10/2000 |

* cited by examiner (a)

(b)

(a)

(b)

DUAL-POLARIZATION RADIATING ELEMENT OF A MULTIBAND ANTENNA

CROSS-REFERENCE

This application is based on French Patent Application No. 10 54 150 filed on May 28, 2010, the disclosure of which is hereby incorporated by reference thereto in its entirety, and the priority of which is hereby claimed under 35 U.S.C. §119.

TECHNICAL FIELD

The present invention pertains to the field of multiband antennas of base stations for radiocommunications. These antennas are most commonly of a "panel" type and comprise dual-polarization radiating elements which are normally aligned.

BACKGROUND

A dual-polarization radiating element generally comprises two dipoles (or systems of dipoles) crossing one another at a 45° orthogonal polarization, one to generate the first polarization signal (−45°) and the other to generate the second polarization signal (+45°). Techniques for constructing radiating elements are varied.

The main conditions for a radiating element, as used in base stations' panel antennas, particularly include:

a) the radio performance of the radiating element (impedance, insulation between the two polarizations, radiation pattern) must be good and stable over a very broad frequency band,
b) the distribution surface area of the radio frequency current (RF) must be sufficient to allow the use of a small-sized reflector for the antenna, with the accompanying decrease in cost,
c) the structure for feeding the radiating element must be simple, such as a single coaxial cable for feeding each polarization of the radiating element,
d) the structure of the radiating element must preferentially enable the use of multiple radiating elements aligned along a common axis, in order to enable the integration of multiband antennas,
e) the radiating element must be as low-cost as possible (using small quantities of material, short assembly times, few parts, and moderate labor costs).

Several families of dual-polymerization radiating elements are already well known and used by manufacturers of different types of antennas. However, none of the existing radiating elements simultaneously and completely fulfills the five conditions described above.

A first family comprises coaxial radiating elements, each formed of two orthogonal half-wave dipoles. Provided that the shape of the dipoles is properly designed, the radio performance of these radiating elements is good. However, all of these radiating elements suffer from a limited surface area for distributing the RF current, which is only concentrated on the two orthogonal half-wave dipoles. Consequently, a wide reflector is necessary to achieve a given horizontal beamwidth on the antenna (65°, for example), which leads to additional costs on the antenna's structure (larger radome, etc.). This first family of radiating elements therefore does not meet condition (b) described above.

A second family comprises radiating elements, each formed of two half-wave dipoles separated by a distance of approximately one-half the wavelength at the operating frequency. The radio performance is good. The RF current's distribution surface area is wide, making it possible to obtain the desired antenna beamwidth with a limited-size reflector. However, the radiating elements must be fed at a four (two points for each polarization) leading to additional complexity and cost for the feeding network. This second family of radiating elements therefore does not meet conditions (c) and (e) described above. Some amount of surface area is available at the center of the radiating element such that it is possible to add a radiating element for multiband operation in order to satisfy condition (d).

There is an alternative radiating element that belongs to the second family. This radiating element has a sufficient surface area to distribute RF current, and it is fed only at two points (one point per polarization). The assembly time and cost of the material may be kept under control, particularly as a result of the milling technique. A major limitation of this type of radiating element is multiband integration. This is because adding radiating elements for a high frequency band requires using the technique of overlapping radiating elements. This means that the upper radiating element cannot use the shared reflector to generate its radiation pattern. The lower radiating elements are then used as reflectors, but their surface area is very low. This alternative from the second family of radiating elements only partially meets condition (d) described above.

A third family comprises dual-polarization radiating elements of the patch type (half-wave). The radio performance is not as good as for radiating elements formed of dipoles, in particular in terms of bandwidth, so condition (a) is only partially satisfied. This radiating element has a sufficient RF current distribution surface area, so that it can be used with a reflector whose dimensions are small. The feeding structure is simple because each dual-polarization radiating element can be fed with just two coaxial cables. The patch radiating element may be designed to have a low cost. It is possible to add another radiating element on top of the patch radiating element. In this situation, the added radiating element must be fed through the patch element, which is not easy. However, the upper radiating element cannot use the shared reflector to generate its radiation pattern, but rather must use the patch radiating element located below it as a reflector, with the drawback of a reduced surface area. This third family of radiating elements therefore only partially meets condition (d) described above.

SUMMARY

It is a purpose of the present invention to propose a dual-polarization radiating element for a multiband antenna, which simultaneously and completely fulfills all of the conditions described above.

The object of the present invention is a dual-polarization radiating element for an antenna, comprising a support with a high dielectric constant whose shape is roughly cylindrical, having an axis of revolution.

at least one first and one second pair of dipoles printed onto a first surface of the support, the dipoles of the first pair being roughly orthogonal to the dipoles of the second pair, conductive lines, in order to feed each dipole, printed onto a second surface of the support, According to one aspect of the invention, the support is placed on a flat reflector, with the cylindrical support's axis of revolution being perpendicular to the plane of the reflector The invention falls within the scope of directive antennas, meaning antennas whose beamwidth in the horizontal plane is divided into sectors. The reflector, owing to its flat shape and its placement perpendicular to the cylindrical support, makes it possible to control the dividing of the pattern in the horizontal plane, meaning the value of its beamwidth (−3 dB).

Preferentially, the first surface supporting the dipoles is the outer surface of the support.

According to a first aspect, the transversal axis passing through the middle of the dipoles is a distance away from the reflector equal to about one-quarter the wavelength at the central operating frequency.

According to a second aspect, the median axes passing through the middles of two consecutive dipoles are about one half-wavelength apart from one another According to a third aspect, the pair of dipoles is fed by a single coaxial cable.

According to a fourth aspect, the support is made up of a material with a high dielectric constant, typically 2.5 to 4.5, and narrow thickness, typically 0.5 mm to 2 mm.

According to one embodiment, the radiating element comprises at least two groups of dipoles. Each group of dipoles comprises at least one first and one seconds pair of dipoles supported by the support, and each group of dipoles operates within a different frequency band.

According to one variant embodiment, the support forms concentric cylinders linked to one another, each cylinder supporting a group of dipoles and each group of dipoles operating within a different frequency band.

According to one embodiment, the diameter of each of the concentric cylinders is a function of the wavelength at the central operating frequency within each of the frequency bands.

According to another embodiment, the concentric cylinders are connected to one another by support parts that are free of dipoles, in order to form a spiral.

According to yet another embodiment, the first group of dipoles disposed on the outer surface of the larger-diameter cylinder functions within the lower-frequency band, and the last group of dipoles disposed on the outer surface of the smaller-diameter cylinder functions within the higher-frequency band.

According to one particular embodiment, a first group of dipoles functions within the GSM frequency band, a second group of dipoles functions within the DCS frequency band, and a third group of dipoles functions within the LTE frequency band.

A further object of the invention is a multiband antenna comprising at least one first radiating element, as previously described, operating within a first frequency band, and at least one second radiating element operating within a second frequency band. The second radiating element is disposed at the center of the cylinder formed by the support of the first radiating element, the first and second radiating elements being disposed on a shared flat reflector.

BRIEF DESCRIPTION OF THE DRAWINGS

Other characteristics and advantages of the invention will become apparent while reading the following description of embodiments, which are non-limiting and given for purely illustrative purposes, and in the attached drawing, in which.

DETAILED DESCRIPTION

Figure 1:
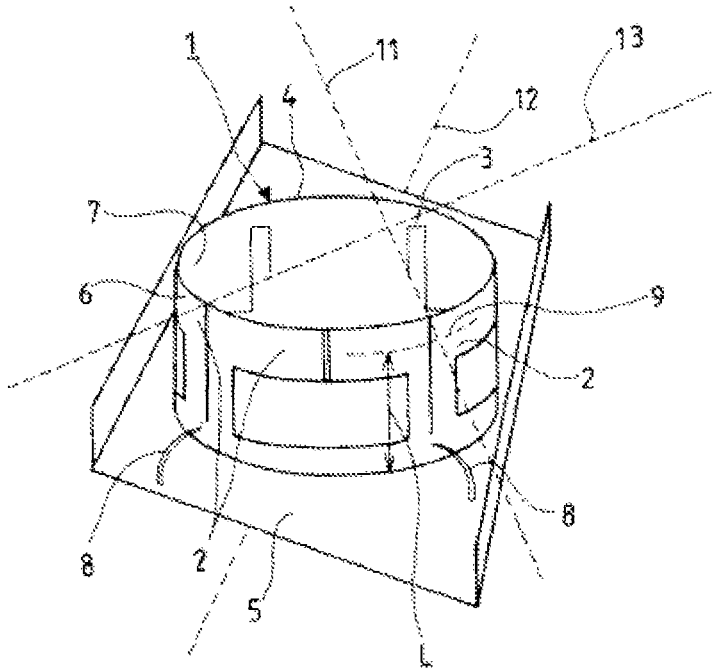
FIG. 1 depicts a radiating element according to a first embodiment of the invention, FIGS. 2*a* and 2*b* respectively show dipoles and feed lines of the radiating element from FIG. 1.
Figure 2:
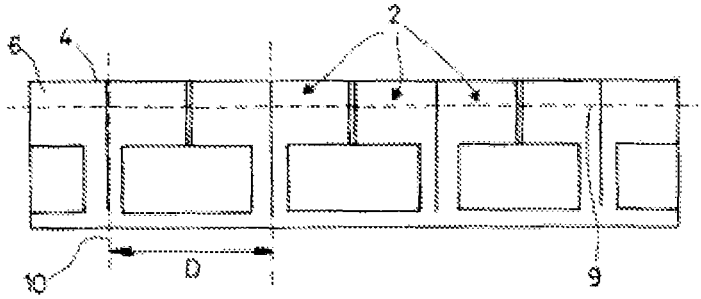
Figure 2:
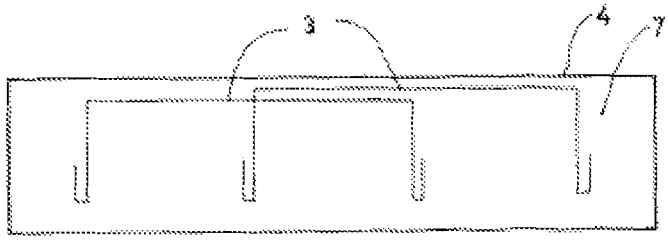

In a first embodiment depicted in FIGS. 1, 2*a*, and 2*b*, the dual-polarization radiating element 1 is formed of two half-wave dipoles 2 each comprising a conductive feed line 3. The dipoles 2 are supported by a shared support 4 that is fastened to the reflector 5. The radiating element 1 is constructed by forming the shared support 4 into a cylindrical shape. The cylindrical support 4 thereby obtained is then positioned in a perpendicular fashion onto a shared flat reflector 5 with multiple radiating elements 1.

In this example embodiment, the dipoles 2 are printed onto a first outer surface 6 of the shared support 4. Each dipole 2 is fed by a conductive line 3 located on the second inner surface 7 opposite the support 4. Naturally, it is possible to print the dipoles on the inner surface and the feed lines on the outer surface. The conductive feed line 3 is, for example, a "microstrip" printed directly on the support 4. This shared support 4, whose circumference is about two wavelengths 2λ, is made of an insulating material with a high dielectric constant (typically 2.5 to 4.5), with a narrow thickness (typically 0.5 mm to 2 mm) and low cost. Alternatively, the air may also constitute a support, in which case the dipoles and feed microstrips may be formed of metal plates connected by insulating elements. Each pair of dipoles 2 is fed at a single point via coaxial cable 8 passing through the reflector 5.

Thus, a group of two pairs of half-wave dipoles 2 at the central frequency of the operating frequency band is achieved. The transversal axis 9 passing through the middle of the dipoles 2 is located a distance L of about a quarter wavelength (λ/4) away, above the surface of the reflector 5. The median axes 10 passing through the middle of the contiguous dipoles 2 are separated from one another by a distance D of about a half-wavelength (λ/2). The diagonal axis 11 passing through the middle of each of the dipoles 2 of the first pair is positioned with a 45° angle relative to the longitudinal axis 12 of the reflector 5 in order to create the −45° polarization, and the diagonal axis 13 passing through the middle of each of the dipoles 2 of the second pair likewise creates the +45° polarization.

Figure 3:
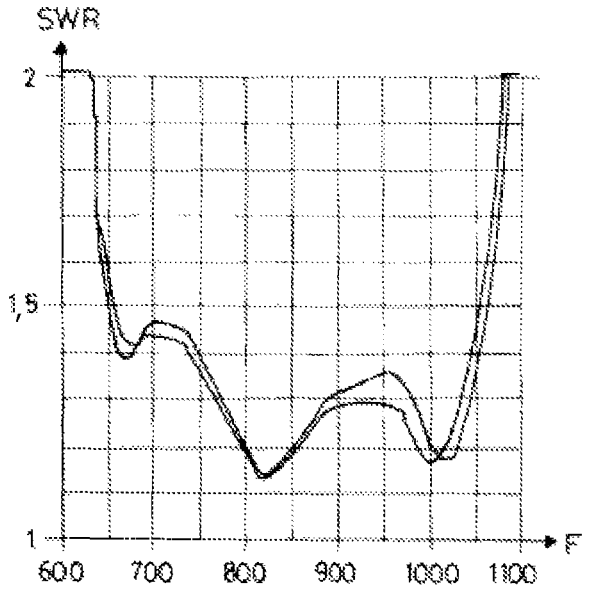
FIG. 3 depicts the standing wave ratio SWR of each pair of dipoles as a function of the frequency F in MHz for the radiating element from FIG. 1.
Figure 4:
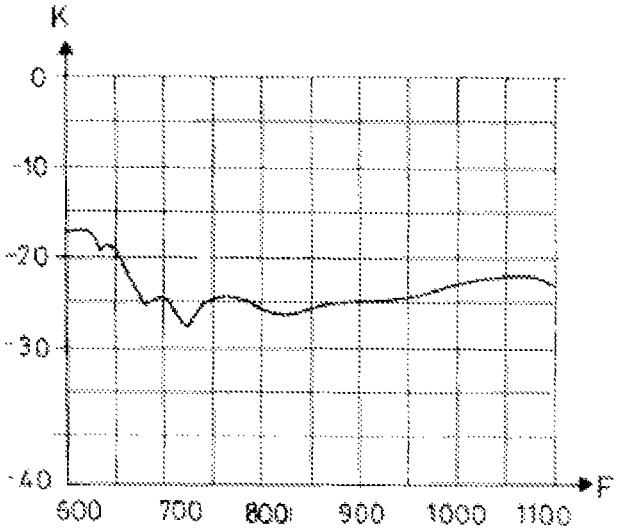
FIG. 4 depicts the decoupling K between the two pairs of dipoles in dB, as a function of the frequency F in MHz for the radiating element from FIG. 1.

The transmission and reflection parameters of the radiating element's two pairs of dipoles, measured within the frequency band of 600 to 1100 MHz, are depicted in FIGS. 3 and 4. These results show very stable characteristics within a large frequency band.

FIG. 3 detects the standing wave ratio SWR of each pair of dipoles as a function of the frequency F in MHz. The standing wave ratio SWR is less than 1.5 for a frequency domain F ranging from 650 to 1050 MHz, i.e. a bandwidth corresponding to 47% of the central frequency of the frequency band.

FIG. 4 depicts the decoupling K in dB between the two pairs of dipoles as a function of the frequency F in MHz. The decoupling K is greater than 20 dB for a frequency domain ranging from 650 to 1100 MHz.

Figure 5:
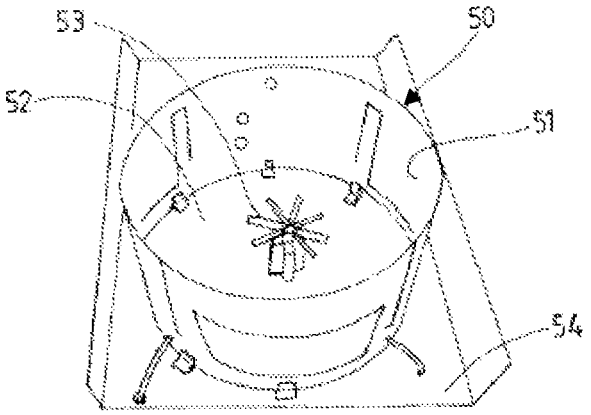
FIG. 5 depicts a radiating element according to a second embodiment of the invention.

Now consider FIG. 5, which depicts another embodiment of a dual-polarization radiating element 50, operating for example at a GSM frequency on the order of 900 MHz, making it possible to form an antenna that operates within a dual frequency band.

The cylindrical shape of the support 51 of the radiating element 50 leaves a large area 52 empty at its center. This free area 52 may be used to add, at the center of the radiating element 50, another radiating element 53 operating within a greater frequency than (DCS 1800 MHz, in this example).

The radiating element 53 may be formed of two orthogonal half-wave dipoles. This may, for example, be a radiating element belonging to the first family described above, or a radiating element that may have any other shape. The height of this radiating element 53 operating at high frequency band is about a quarter-wavelength (λ/4). As the radiating element 53 with a high frequency band is placed above the shared reflector 54, the characteristics of its radiation pattern are maintained.

Figure 6:
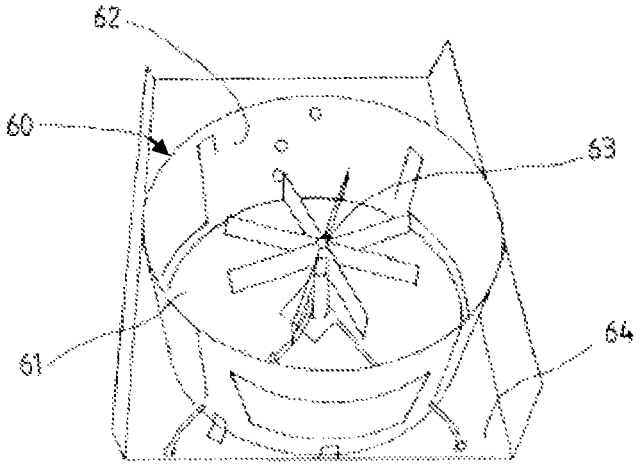
FIG. 6 depicts a radiating element according to a third embodiment of the invention.

FIG. 6 depicts another embodiment of a dual-polarization radiating element 60, operating for example at a CDMA frequency on the order of 800 MHz, making it possible to form an antenna that operates within a dual frequency band.

As the empty area 61 in the middle of the cylinder formed by the support 62 of the radiating element 60 is very large, it is possible to insert a radiating element 63 into it that operates at lower frequencies and has greater dimensions. The diameter of the cylindrical support 62 depends on the wavelength at the central operating frequency in the highest frequency band (in this example, 800 MHz). The radiating element 63, whose type is called "butterfly", is formed of two dipoles crossing each other at an orthogonal polarization±45°. The radiating element 63 inserted into the center of the cylindrical support 62 operates within a low-frequency band (for example, LTE 700 MHz). It is a thereby possible to construct an antenna operating within a dual band at relatively similar frequencies, such as LTE 700 MHz and CDMA 800 MHz, working from the dual-polarization radiating element 62. The two radiating elements 62 and 63, disposed concentrically, use the shared reflector 64, and the antenna's width can consequently be reduced.

Figure 7:
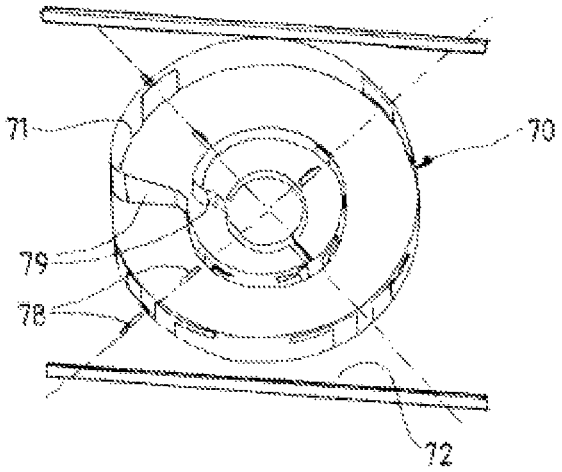
FIG. 7 is a schematic perspective view of a radiating element according to a fourth embodiment of the invention, FIGS. 8*a* and 8*b* respectively show dipoles and feed lines of the radiating element from FIG. 7.
Figure 8:
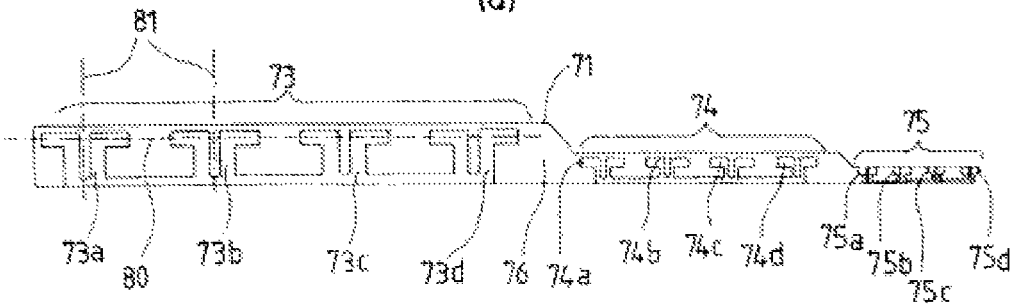
Figure 8:
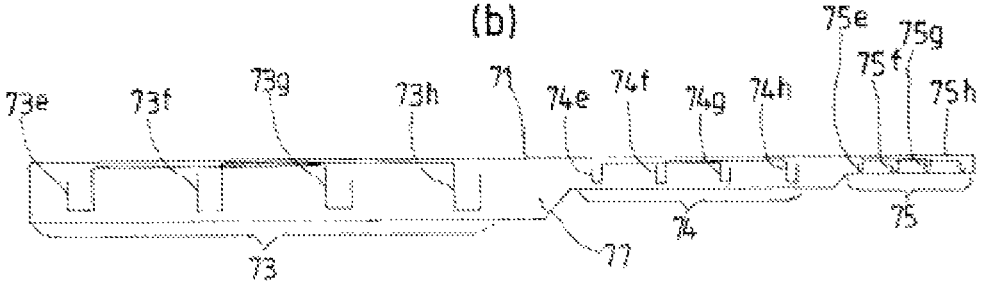

FIGS. 7, 8*a*, and 8*b* depict a dual-polarization radiating element 70 capable of operating within multiple frequency bands. The multiband radiating element 70 is constructed of a single part. All the dipoles and feed lines needed for the radiating element to operate 70 are supported by a shared support 71 fastened onto a shared reflector 72. This substrate 71 may have a low cost and comprise a reduced quantity of insulating material.

In this example, the radiating element 70 is a three-band element. Three groups 73, 74, 75 of four dipoles each 73*a* . . . 73*d*, 74*a* . . . 74*d*, 75*a* . . . 75*d* are printed on a first outer surface 76 of the shared support 71. Each group 73, 74, 75 corresponds to a different frequency band. Each dipole 73*a* . . . 73*d*, 74*a* . . . 74*d*, 75*a* . . . 75*d* is individually fed by a microstrip line 73*e* . . . 3*h*, 74*e* . . . 74*h*, 75*e* . . . 75*h* printed on the second lower surface 77 opposite the shared support 71. Each group 73, 74, 75 of four dipoles is fed by just two coaxial cables 78 crossing the reflector 72, leading to a total of six coaxial cables 78 for the three-ban dual-polarization radiating element 70.

The single shared support 71 is formed by means of three cylindrical shapes of different diameters such that the parts of the support 71 related to each group 73, 74, 75 form concentric cylinders whose diameters depend on the wavelength at the central operating frequency in each of the frequency bands. The length of the support 71 is calculated such that the three concentric cylinders are connected to one another by support parts 79 that have no dipoles. The group 73 of dipoles 73*a* . . . 73*d* disposed on the outside of the largest-diameter cylinder operates at the lower frequency, and the group 75 of dipoles 75*a* . . . 75*d* disposed on the inside of the smallest-diameter cylinder operates at the highest frequency. Three groups 73, 74, 75 each of two pairs of half-wave dipoles are therefore obtained, each at the central frequency of their respective operating frequency bands, for example GSM 900 MHz (73), DCS 1800 MHz (74) and LTE 2600 MHz (75).

The transversal axis 80 passing through the middle of the dipoles of each group is located at a distance L of about a quarter wavelength away (λ/4) at the central operating frequency, above the surface of the reflector 72. The median axes 81 passing through the middle of two consecutive dipoles are about a half-wavelength (λ/2) away from one another at the central operating frequency. The dipoles 73*a* . . . 73*d*, 74*a* . . . 74*d*, 75*a* . . . 75*d* are positioned so as to create two orthogonal polarization signals within each of three operating frequency bands.

If need be, frequency band separating devices may be printed on the inner surface 77 of the shared support 71 supporting the microstrip lines 73*e* . . . 73*h*, 74*e* . . . 74*h*, 75*e* . . . 75*h*. These devices make it possible to use only two coaxial cables in total, i.e. one cable per polarization, to feed the three-band dual-polarization radiating element.

Naturally, the present invention is not limited to the described embodiments, but rather is subject to many variants accessible to the person skilled in the art without departing from the spirit of the invention. In particular, the principle described above for three frequency bands may be extended to designing a multiband dual-polarization radiating element operating on more than three frequency bands.

The invention claimed is:

1. An antenna comprising a plurality of dual-polarization radiating elements placed on a flat shared reflector, each dual polarization radiating element, comprising:

a support with a high dielectric constant whose shape is roughly cylindrical having an axis of revolution, at least one first and one second pair of dipoles printed onto a first surface of the support, the pairs of dipoles crossing each other at an orthogonal polarization and each pair of dipoles being fed by a conductive feed line, the conductive lines feeding each pair of dipoles being printed onto a second surface of the support, wherein the support is placed on the flat shared reflector, with the cylindrical support's axis of revolution being perpendicular to the plane of the reflector.

2. The antenna according to claim 1, wherein the first surface supporting the dipoles is an outer surface of the support.

3. The antenna according to claim 1, wherein a transversal axis passing through a middle of the dipoles is a distance away from the reflector equal to about one-quarter of a wavelength at the central operating frequency.

4. The antenna according to claim 1, wherein a median axes passing through a middle of each of two consecutive dipoles are about one half wavelength apart from one another.

5. The antenna according to claim 1, wherein the pair of dipoles is fed by a single coaxial cable.

6. The antenna according to claim 1, comprising at least two groups of dipoles, each group of dipoles comprising at least a first and a second pair of dipoles supported by the support, and each group of dipoles operating within a different frequency band.

7. The antenna according to claim 6, wherein the support forms concentric cylinders linked to one another, each cylinder supporting a group of dipoles and each group of dipoles operating within a different frequency band.

8. The antenna according to claim 7, wherein a diameter of each of the concentric cylinders is a function of a wavelength at the central operating frequency within each of the frequency bands.

9. The antenna according to claim 7, wherein the concentric cylinders are connected to one another by support parts that are free of dipoles, in order to form a spiral.

10. The antenna according to claim 7, wherein the first group of dipoles disposed on an outer surface of a larger-diameter cylinder functions within a lower-frequency band, and a last group of dipoles disposed on the outer surface of a smaller-diameter cylinder functions within a higher-frequency band.

11. The antenna according to claim 10, wherein a first group of dipoles functions within a GSM frequency band, a second group of dipoles functions within a DCS frequency band, and a third group of dipoles functions within a LTE frequency band.

12. The antenna according to claim 1, comprising at least one first radiating element operating within a first frequency band, and at least one second radiating element operating within a second frequency band, wherein the second radiating element is disposed at the center of the cylinder formed by the support of the first radiating element, the first and second radiating elements being disposed on the shared flat reflector.

13. The antenna according to claim 6, wherein a first group of dipoles functions within a GSM frequency band, a second group of dipoles functions within a DCS frequency band, and a third group of dipoles functions within an LTE frequency band.

* * * * *